US006216715B1

(12) United States Patent
Howe

(10) Patent No.: US 6,216,715 B1
(45) Date of Patent: Apr. 17, 2001

(54) CONVERTIBLE TENT FOR RAIN, COLD, AND HOT CONDITIONS

(76) Inventor: Robert H. Howe, 1225 NW. Foxwood Pl., Bend, OR (US) 97701-8606

( * ) Notice: Subject to any disclaimer, the term of this patent is extended or adjusted under 35 U.S.C. 154(b) by 0 days.

(21) Appl. No.: 09/364,344

(22) Filed: Jul. 30, 1999

(51) Int. Cl.[7] ..... E04H 15/30
(52) U.S. Cl. ..... 135/95
(58) Field of Search ..... 135/95, 93, 115, 135/117, 97, 124, 128

(56) References Cited

U.S. PATENT DOCUMENTS

| | | | | |
|---|---|---|---|---|
| 2,391,871 | | 1/1946 | Benson | 160/368 |
| 2,666,441 | | 1/1954 | Powers | 135/14 |
| 3,598,133 | * | 8/1971 | Abert . | |
| 3,800,814 | | 4/1974 | Hibbert | 135/1 R |
| 3,970,096 | | 7/1976 | Nicolai | 135/14 V |
| 4,077,417 | | 3/1978 | Beavers | 135/3 R |
| 4,078,572 | * | 3/1978 | Moss . | |
| 4,165,757 | * | 8/1979 | Marks . | |
| 4,265,261 | | 5/1981 | Barker | 135/3 R |
| 4,269,210 | * | 5/1981 | Marks . | |
| 4,709,718 | * | 12/1987 | Nichols . | |
| 4,858,635 | | 8/1989 | Eppenbach | 135/104 |
| 5,394,897 | | 3/1995 | Ritchey et al. | 135/124 |
| 5,467,794 | | 11/1995 | Zheng | 135/125 |
| 5,579,799 | | 12/1996 | Zheng | 135/126 |
| 5,606,986 | * | 3/1997 | Muise . | |
| 5,765,584 | | 6/1998 | Heisler et al. | 135/93 |

* cited by examiner

*Primary Examiner*—Alvin Chin-Shue
*Assistant Examiner*—Sarah Purol
(74) *Attorney, Agent, or Firm*—David Pressman

(57) ABSTRACT

A convertible tent comprises an inner canopy (12) having a window (22) and a flysheet or outer canopy (36) spaced above and covering the inner canopy. The flysheet has a window (36P) in alignment with the canopy's window. The canopy's window can be closed with either a solid (26) or a net panel (24). This window has, around its edge, a row of zipper teeth (a zipper chain—30), which teeth mate with respective zipper chains (32, 34) on the solid and net panels. Thus either the solid panel or the net panel can be zipped into the inner canopy's window. A solid panel can also be zipped into the window in the flysheet. The tent can be adjusted for warm, cool, cold, and precipitation conditions from inside by using just the net panel in the inner canopy, just the solid panel of the inner canopy, or the solid panel o the inner canopy and the solid panel of the flysheet.

23 Claims, 3 Drawing Sheets

CONVERTIBLE TENT FOR RAIN, COLD, AND HOT CONDITIONS

BACKGROUND

1. Field of Invention

This invention relates generally to tents, specifically to a tent that can be converted for use in different climactic conditions.

2. Prior Art

The art is replete with tents and other enclosure devices with conversion features for different climactic conditions, but such tents are not versatile, simple, easy to use, effective, or reliable.

Benson, in U.S. Pat. No. 2,391,871 (1946) shows a canvas covering with a window. One side of the window is attached to the canvas and the other sides are removably attached to the canvas by a zipper. This device is simple, but can only be opened or closed and thus cannot adapt to a range of climactic conditions, such as rain, heat, cold, etc.

Powers, in U.S. Pat. No. 2,666,441 (1954) shows a tent window comprising a pocket in the tent and a transparent sheet that is inserted in the pocket. A flap also can cover the opening. Although more complex and versatile, this device is awkward, heavy, and difficult to adjust for differing climactic conditions.

Hibbert, in U.S. Pat. No. 3,800,814 (1974) shows a tent that resembles an elongated building with a curved roof, such as the Quonset brand. The sidewall has a vertical zipper and two bottom horizontal zippers, as shown in FIG. 6. While somewhat versatile, this tent is difficult to adjust rapidly and easily and lacks good versatility.

Nicolai in U.S. Pat. No. 3,970,096 (1976) shows another elongated tent; this one has spaced inner and outer porous layers. The layers are supported by tent poles that extend transversely over the tent.

This arrangement is complex and awkward and hence difficult to adjust and use.

Beavers, in U.S. Pat. No. 4,077,417 (1978) shows a tent with frame members that have ends inserted in multi-socket connectors. Again, it lacks versatility for different climactic conditions. Barker, in U.S. Pat. No. 4,265,261 (1981) shows a pyramidal tent with triangular side windows which are covered by triangular, awning-like covers. While unique, this arrangement is complex, difficult, and awkward to adjust, and still lacks good versatility.

Eppenbach, in U.S. Pat. No. 4,858,635 (1989) shows a tent having a ceiling opening that can be covered by a pivotable member attached to a flap. The tent also has a rain fly that the pivotable member can support. While somewhat versatile, this arrangement is not simple to use and is complex to fabricate.

Ritchey and Leavitt, in U.S. Pat. No. 5,394,897 (1995) shows interconnected tents. Modules that zip onto the tent openings connect the tents. The tent has inner and outer panels. They are mated by pairs of zippers as follows: inner: 72–74; outer 78–80. However they don't interconnect in a simple, reliable manner and do not provide a simple, versatile arrangement for a single user.

Zheng, in U.S. Pat. Nos. 5,467,794 (1995) and 5,579,799 (1996) shows a tent with collapsible shade awnings. The frame has hinged members. This arrangement suffers from the same disadvantages as Barker, supra.

Heisler and Remza, in U.S. Pat. No. 5,765,584 (1998) show a tent with a two-ply door. The first ply is porous for air venting and the second ply is waterproof. The waterproof ply is attached by a zipper with two zipper slides or pulls such that the waterproof layer can be opened at the top or bottom. While somewhat versatile, this arrangement is still relatively complex and awkward to use, erect, and fabricate.

Another type of convertible tent is made by Sierra Designs of Emeryville, Calif. and sold under the trademark Nightwatch. This tent consists of an inner canopy with a window. The window has a solid panel that can be zipped open. A net panel (netting) that prevents mosquitoes from entering covers the outside of this window. This inner canopy is suspended from several arched tent poles. An outer waterproof flysheet is spaced about 7.5–13 cm away from the inner canopy, on the outside of the poles. When the solid panel is opened, the netting allows the occupants of the tent to see the sky, get ventilation, preserves the structural integrity of the tent, and keeps insects out. Thus the tent is convertible since opening the panel ventilates the tent when it is warm outside, e.g., in the summer. Closing the panel makes the tent warmer for cooler weather, e.g., in the spring and fall. The outer flysheet in installed to cover the window whenever external conditions, such as rain or snow, require more shielding. The flysheet is left partially off to enjoy the view and have ventilation when the weather is clement. However when precipitation occurs, installing the flysheet to cover the window is awkward: Since the netting covers the opening, an occupant must scramble out to arrange the flysheet to cover the window. The occupants and the inside of the tent will get wet or colder in the meantime. Even if the flysheet is installed to cover the window, spindrift (fine, wind-blown snow) will pass through the zipper of the flysheet and under the bottom of the flysheet. The netting will catch and hold the snow, so that the next time the window is open, the spindrift will fall into the tent.

OBJECTS AND ADVANTAGES

Accordingly, several objects and advantages of the invention are to provide an improved convertible tent which is more versatile, less awkward to use and handle, simple, easy to make and erect, and easily adjustable for a wide range of climactic conditions. It can be adjusted for different conditions, especially for rain, from the inside. It will not have an outer net to catch spindrift in the winter and the flysheet can be installed from inside the tent Further objects and advantages will become apparent from a consideration of the ensuing description and the accompanying drawings.

DRAWING FIGURES

SUMMARY

In accordance with the invention, a convertible tent comprises an inner canopy having a convertible opening or window and a flysheet or outer canopy spaced above and covering the inner canopy. The flysheet has a convertible opening or window in alignment with the canopy's window. The canopy's window can be closed with either a solid or a net panel. This window has, around its edge, a row of zipper teeth (a zipper chain), which teeth mate with respective zipper chains around the solid and net panels. Thus either the solid panel or the net panel can cover the inner canopy's window. A panel can be zipped into or out of the aligned window in the flysheet.

Figure 1:
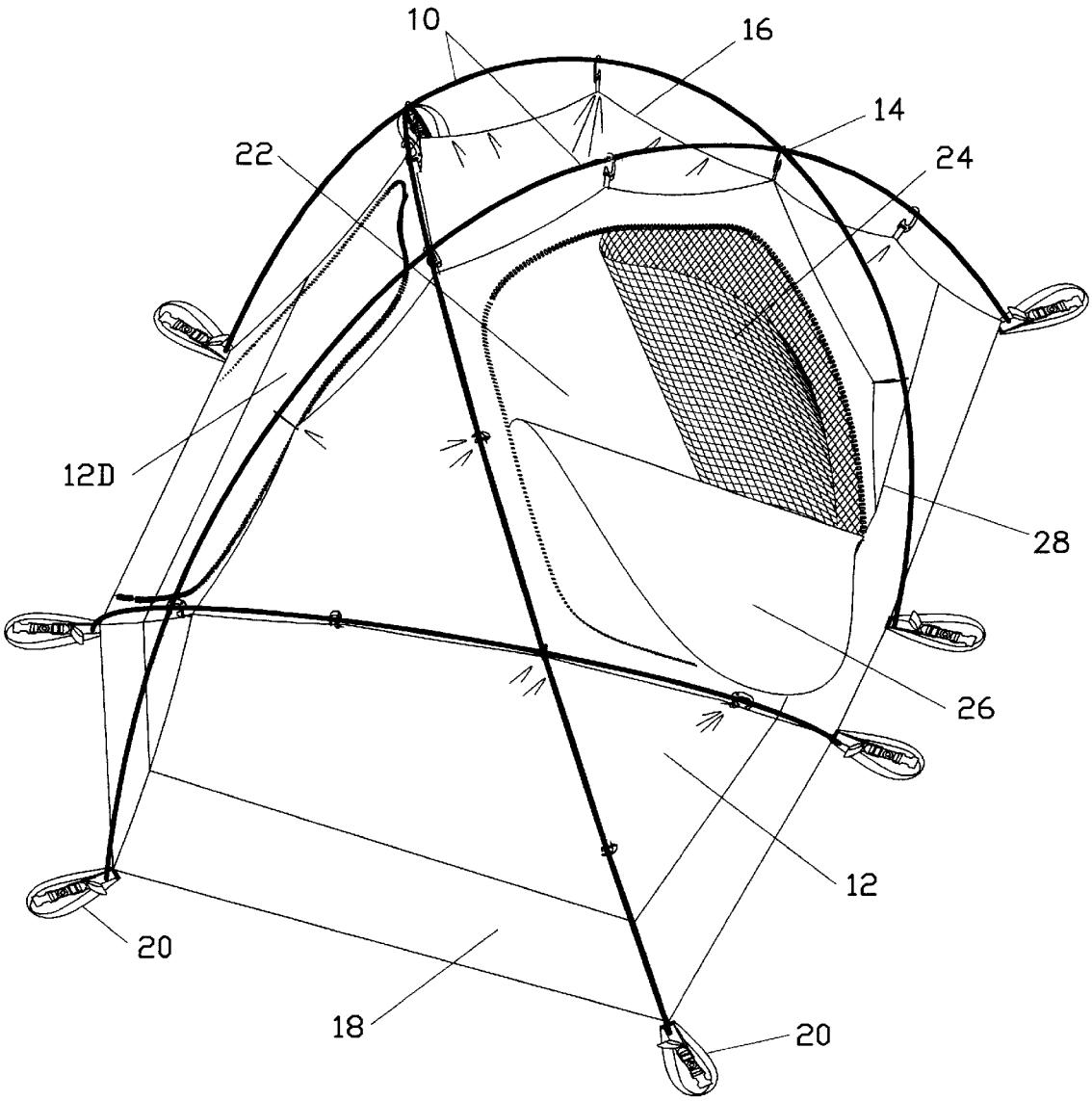
FIG. 1 is a perspective view from above of a tent according to the invention without its flysheet.

Description—FIG. 1—Inner Canopy With Dual-Closable Window

FIG. 1 shows a perspective view from above of the inner part of a tent according to the invention. A plurality of conventional tent poles 10 form an arched cage. The ends of these poles are anchored to the ground conventionally. An inner canopy, canvas, or tent body 12 is suspended from the poles by conventional hooks and web loops 14, shown in more detail in FIG. 4. The web loops are attached to seams or reinforcing cords 16 in canopy 12. The main portion of the floor of the tent is not shown, but it has conventional upturned sidewalls 18 that cover the bottom portion of the canopy. The canopy has a conventional door 12D on its left side (as seen in the drawing). The bottom edges of the tent have conventional web loops and attachments 20 at the bottoms of the poles.

Figure 2:
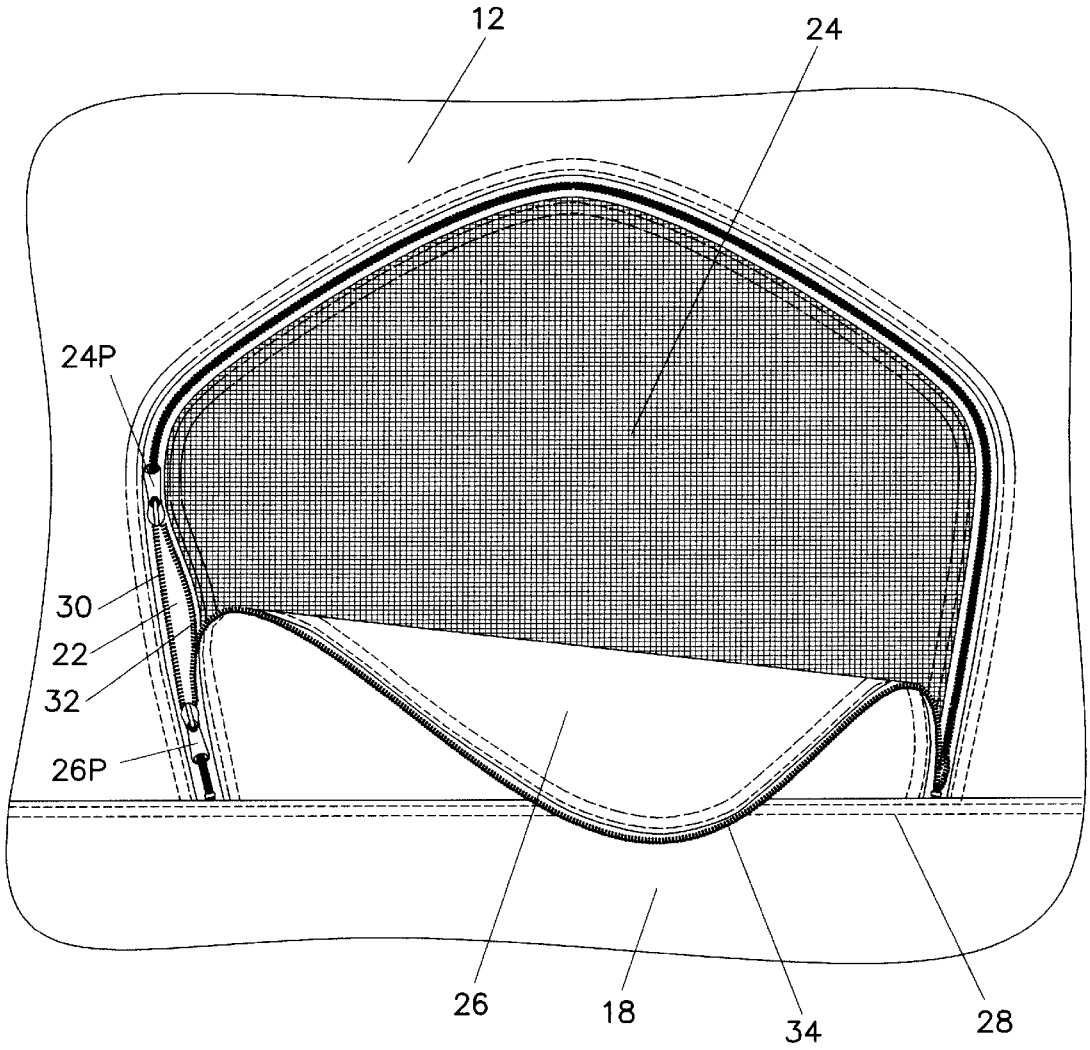
FIG. 2 is a view of part of a portion of an inner canopy of the tent showing an arrangement of zippers used on a window thereof.

In accordance with the invention, canopy 12 has a convertible opening or window 22 on its right or front side (as seen in the drawing) that can be closed by either of two panels: a net panel 24 or a solid panel 26. Net panel is made of conventional mosquito netting and solid panel 26 is made of the same material as canopy 12 and is attached at its bottom to the outside of the net panel. As shown in FIG. 2, either of these panels can be alternatively zipped into window 22 so as to close the window with either a solid or a net closure.

Canopy 12 preferably is made of breathable rip-stop nylon; the tent floor is made of nylon with a waterproof coating, and the poles are made of aluminum, either solid or in sections. In one version the tent was about 1.5 m high., and window 22 was about 75 cm high and about 1 m wide.

Figure 3:
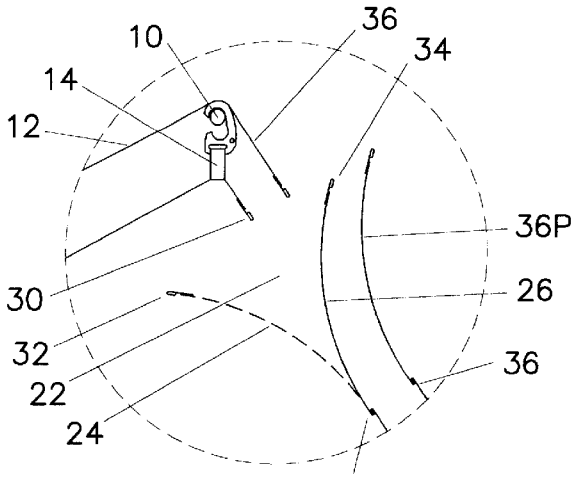
FIG. 3 is a schematic, section-like partial view of the window, including a flysheet panel, showing area 3 of FIG. 4 in detail.

Description—FIGS. 2 and 3—Dual Window

FIG. 2 shows window 22 in detail. While shown as having a Tudor arch shape, it can have other shapes, such square, rectangular, triangular, circular, oval, hemispherical, etc. Either net panel 24 or solid panel 26 can be used to close or fill the window and each has the same shape as the window. Both are attached across their bottom edges to inner canopy 12, preferably at the seam of one of the upturned sidewalls 18 of the floor. Starting from the outside, the stitches 28 attach the following parts together at the bottom of window 22: the top edge of part of sidewall 18, then solid panel 26, then net panel 24, and then an edge of canopy 12.

The edge of canopy 12 (other than the bottom part that is sewn by stitches 28) has a zipper chain or row of teeth 30, which constitutes one side of a zipper. This chain can mate with a chain 32 (a mating half of the zipper) on net panel 24 or a chain 34 (another mating zipper half) on solid panel 26. One zipper pull or slide 24P is used to zip chain 32 of net 24 to chain 30 of canopy 12, while another pull 26P is used to zip teeth 34 of solid panel 26 to chain 30. Thus window 22 can be closed with either of panels 26 or 26 through the use of what is in effect 1 ½ zippers. Zipper pulls 24P and 26P are dual pulls which can be operated from inside or outside the tent. Net zipper pull 24P is started from the right side of the window and solid panel pull 26P is started from the left side.

FIG. 3 shows another, schematic view of the window panels that will aid in understanding. Ignoring optional flysheet 36 temporarily, note that canopy 12 is suspended by hook and web loop 14, which in turn hangs from pole 10. The edge of widow 22 in canopy 12 has zipper chain 30 around its sides (except the bottom where stitches 28 are used). The user can fasten net panel 24 to chain 30 by means of its chain 32, thereby closing the window with netting. Alternatively the user can fasten solid panel 26 to chain 30 by means of its chain 34, thereby closing the window with a solid panel.

Operation—FIGS. 2 and 3—Dual Window

Users can deploy the tent, as thus far described, with canopy 12 and its dual-closable window, without the flysheet, yet it has significant advantages. When both panels 24 and 26 (net and solid) are not in the window, pull 24P of net panel 24 is to the far right (FIG. 2) and a pull 26P of solid panel 26 is to the far left (not shown).

In warm weather, the user zips net panel 24 into window 22 by holding the net panel in the window and drawing pull 24P from right to left to attach chain 32 to chain 30, thereby to install the net panel in the window. The user then will obtain good ventilation and a view of the sky through the net, yet the net prevents mosquitoes and other insects from entering. When net 24 is zipped into place, solid panel 26 is left to hang down, on the outside of the window. Due to the use of two-sided pulls, the user can zip net 24 into place or unzip it from the inside or outside.

In cooler weather, the user zips solid panel 26 into window 22 by unzipping the net panel (if it is in the window) and holding the solid panel in the window and pulling pull 24P from left to right to attach chain 34 to chain 30. This will install the solid panel in the window. The user thus obtains a solid shield to keep the tent warmer. When solid panel 26 is zipped into place, net panel 24 is left to hang down, inside the window. As with the net panel, the user can zip panel 26 into place or unzip it from the inside or outside.

Since the net panel is never on the outside of the canopy in cooler or cold weather as in prior designs, snow or spindrift will not accumulate in the net. Since both panels can be removed from inside the tent, the occupants can reach outside to adjust portions of the tent and open the window of the flysheet, as will be described.

Figure 4:
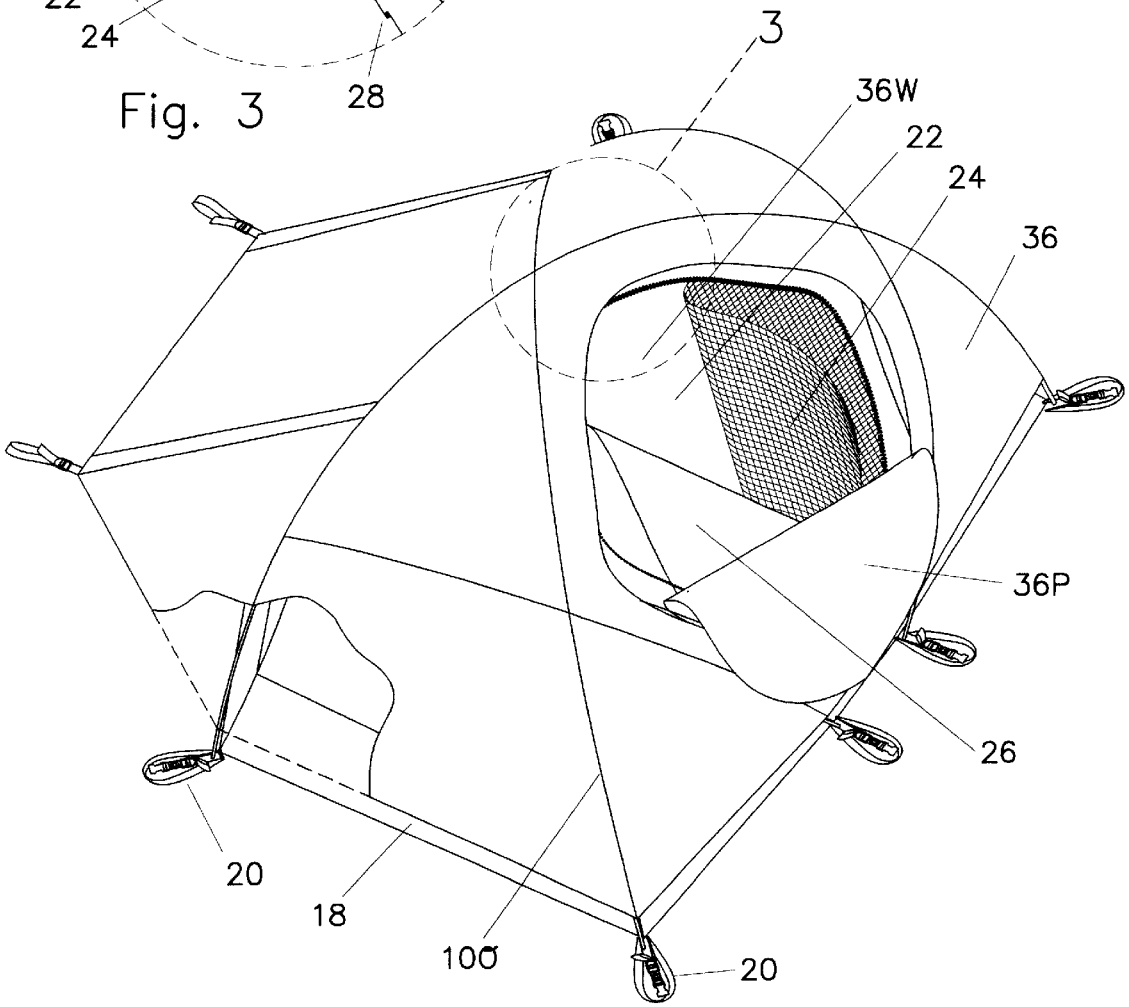
FIG. 4 is a perspective view from above of the tent with its flysheet.

Description—FIGS. 3 and 4—Flysheet

As shown in FIGS. 3 and 4, flysheet 36 covers the tent structure of FIG. 1 (the pole cage and underlying canopy 12). Flysheet lies on top of hooks and web loops 14, and poles 10, and is attached to web loops 14 and poles 10 in conventional fashion by conventional quick-release buckles (not shown) so that outlines 10O of the poles show through (FIG. 4). Flysheet 36 has a window 36W and a flysheet panel 36P that the user can zip into the window. The zipper (not shown) extends around the window on all sides, except the bottom, and also has a dual pull (not shown) so that the flysheet panel can be zipped in place from the inside or outside.

Operation—FIGS. 3 and 4—Flysheet

The user many choose not to deploy the flysheet in warm weather. In cold (but not very cold) weather, and when there is no precipitation, the flysheet can be used, but with its window open. If it turns very cold, or rains or snows, the occupants can close the flysheet window by opening window 22 of canopy 12, pulling up flysheet panel 36P through window 22, and zipping panel 36P in place. Then the occupants can zip solid panel 26 in place to close window 22. Even if spindrift leaks through the zipper of the flysheet, or blows under the flysheet, it will not be able to accumulate on any net since net 24 is inside the tent. The occupants can also open a closed flysheet from inside when the precipitation stops or if it gets warmer.

Conclusions, Ramifications, and Scope

Accordingly the reader will see that, according to the invention, I have provided an improved convertible tent which is more versatile, less awkward to use and handle, simple, easy to make and erect, and easily adjustable for a wide range of climactic conditions. The user can adjust the tent for warm weather by not using the flysheet and just using the net, for cooler conditions by using the panel in the canopy and for cold or precipitation by using the flysheet and closing its panel. All variations can be implemented from the inside, without the occupants getting out of the tent and being exposed to the precipitation or cold. The tent does not have an outer net to catch snow in the winter and the user can install and remove the flysheet from inside the tent.

While the above description contains many specificities, these should not be construed as limitations on the scope of the invention, but as exemplifications of the presently preferred embodiments thereof. Many other ramifications and variations are possible within the teachings of the invention. For example, the flysheet window can be clear. Different materials, sizes, and interconnections can be used for all components. In lieu of zippers, hook-and-loop fasteners, snaps, buttons, rib and slot slide closures, etc can attach the panels. Several windows can be used in a tent, and two complete zippers can be used on the inner panel window by providing the canopy with dual layers around the window. The flysheet can be omitted and just the inner canopy can be used with its advantageous alternative net and solid panels and its 1½ zippers. The flysheet can be spaced closer or adjacent to the inner canopy by changing hooks and web loops 14. In lieu of net and solid panels on the inner canopy, any other two different panels can be used, such as transparent and opaque, The inner canopy can have a fixed net window with an adjacent openable slot or window and the flysheet can have an openable window (e.g., a panel with a U-shaped zipper) which is reachable through the slot in the inner canopy.

Thus the scope of the invention should be determined by the appended claims and their legal equivalents, and not by the examples given.

REFERENCE NUMERALS

10 tent poles
100 outlines of poles
12 inner canopy
14 hooks and web loops
16 reinforcing cords
18 upturned sidewalls
12D door
20 web loops and attachments
22 window or convertible opening
24 net panel
24P zipper pull
26 solid panel
26P zipper pull
30 zipper chain on window
32 zipper chain on net panel
34 zipper chain on solid panel
36 flysheet or outer canopy
36P flysheet panel

What is claimed is:

1. A tent, comprising:

a solid canopy, said solid canopy being supported to cover and enclose an above-ground volume, said solid canopy having a selectively closable opening with an edge surrounding said opening, a flysheet canopy mounted over and covering said solid canopy, said flysheet canopy having a window opening which can be reached through said selectively closable opening of said solid canopy, said window opening of said flysheet canopy containing a flysheet panel that, from inside said solid canopy, can be can be installed in said window opening to occlude said window opening or removed from said window opening to leave said window opening patent.

2. The tent of claim 1 wherein said flysheet canopy is spaced from said solid canopy and where said flysheet panel has a plurality of sides, one of which is permanently attached to said flysheet.

3. The tent of claim 1 wherein said solid canopy has:

(a) two different panels for alternatively filling and closing said selectively closable opening, said two different panels being designated first and second panels, said first panel and said second panel each having a surrounding edge, a part of said edge of said net panel and a part of said edge of said solid panel being attached to said solid canopy surrounding said opening, said panels each having a remaining edge portion, and (b) an attachment for alternatively attaching said remaining portion of said first panel or said remaining portion of said second panel to said edge of said solid canopy surrounding said opening, such that either said entire first panel or said entire second panel can be attached to said edge of said solid canopy surrounding said opening to fill said opening, or said opening can be left open.

4. The tent of claim 3 wherein said attachment comprises a zipper including a first panel zipper chain on said remaining edge portion of said net panel, a second panel zipper chain on said remaining edge portion of said solid panel, and a canopy opening zipper chain on said edge of said solid canopy surrounding said opening, and two zipper pulls for mating either said first panel zipper chain or said second panel zipper chain to said canopy opening zipper chain.

5. The tent of claim 3 wherein said solid canopy is supported by a plurality of tent poles which arch over said solid canopy and suspend said solid canopy from said tent poles.

6. The tent of claim 3 wherein said first panel is a net panel and said second panel is a solid panel.

7. A tent, comprising:

a solid canopy, said solid canopy being supported to cover and enclose an above-ground volume, said solid canopy having a convertible opening with an edge surrounding said opening, said solid canopy having two different panels for alternatively filling and closing said opening, said two different panels being designated first and second panels, said first panel and said second panel each having a surrounding edge, a part of said edge of said net panel and a part of said edge of said solid panel being attached to said canopy surrounding said opening, said panels each having a remaining edge portion, an attachment for alternatively attaching said remaining portion of said first panel or said remaining portion of said second panel to said edge of said solid canopy surrounding said opening, such that either said entire first panel or said entire second panel can be attached to said edge of said solid canopy surrounding said opening to fill said opening, or said opening can be left open, and a flysheet canopy mounted over and covering said solid canopy, said flysheet canopy having a window opening aligned with said convertible opening of said solid canopy.

8. The tent of claim 7 wherein said attachment comprises a zipper including a first panel zipper chain on said remaining edge portion of said net panel, a second panel zipper chain on said remaining edge portion of said solid panel, and a canopy opening zipper chain on said edge of said solid canopy surrounding said opening, and two zipper pulls for mating either said first panel zipper chain or said second panel zipper chain to said canopy opening zipper chain.

9. The tent of claim 7, further including a plurality of tent poles which arch over said solid canopy to support by and suspend said solid canopy from said tent poles, said flysheet canopy being positioned above said tent poles.

10. The tent of claim 7 wherein said window opening of said flysheet canopy contains a removable panel that can be removed and installed in said window opening of said flysheet canopy from inside said solid canopy.

11. The tent of claim 7 wherein:

said attachment comprises a zipper including a first panel zipper chain on said remaining edge portion of said net panel, a second panel zipper chain on said remaining edge portion of said solid panel, and a canopy opening zipper chain on said edge of said solid canopy surrounding said opening, and two zipper pulls for mating either said first panel zipper chain or said second panel zipper chain to said canopy opening zipper chain said solid canopy is supported by a plurality of tent poles which arch over said canopy and suspend said solid canopy from said poles, said flysheet canopy being positioned above said tent poles, and said window opening of said flysheet canopy contains a removable panel that can be removed and installed in said window opening of said flysheet canopy from inside said solid canopy.

12. An attachment system for attaching either a first panel or a second panel to a sheet of material, comprising:

a first panel zipper chain on an edge portion of said first panel, a second panel zipper chain on an edge portion of said second panel, a sheet-of-material zipper chain on an edge of said sheet of material, and two zipper pulls for mating either said first panel zipper chain or said second panel zipper chain to said sheet-of-material zipper chain.

13. The attachment system of claim 12 wherein said sheet of material is a solid canopy for a tent, said canopy has a window, and said sheet-of-material zipper chain is mounted on an edge portion of said window, whereby either said first panel or said second panel can alternatively be zipped into said window.

14. The attachment system of claim 13, further including a flysheet canopy mounted over and covering said solid canopy, said flysheet canopy having an opening aligned with said window of said solid canopy.

15. A tent, comprising:

a solid canopy, said solid canopy being supported to cover and enclose an above-ground volume, said solid canopy having a convertible opening with an edge surrounding said opening, said solid canopy having two different panels for alternatively filling and closing said opening, said two different panels being designated first and second panels, respectively, each of said first and second panels having a surrounding edge, a part of said edge of said first panel and a part of said edge of said second panel being attached to said solid canopy surrounding said opening, said panels each having a remaining edge portion, an attachment for alternatively attaching said remaining portion of said first panel or said remaining portion of said second panel to said edge of said solid canopy surrounding said opening, such that either said entire first panel or said entire second panel can be attached to said edge of said solid canopy surrounding said opening to fill said opening with either said first or said second panel, or said opening can be left open.

16. The tent of claim 15 wherein said attachment comprises a zipper including a first panel zipper chain on said remaining edge portion of said first panel, a second panel zipper chain on said remaining edge portion of said second panel, and a canopy opening zipper chain on said edge of said solid canopy surrounding said opening, and two zipper pulls for mating either said first panel zipper chain or said second panel zipper chain to said canopy opening zipper chain.

17. The tent of claim 15 further including a plurality of tent poles supporting solid canopy, said tent poles arching over said canopy and suspending said canopy from said poles.

18. The tent of claim 17, further including a flysheet canopy mounted over and covering said solid canopy, said flysheet canopy having an opening aligned with said convertible opening of said solid canopy.

19. The tent of claim 15 wherein said first panel is a net panel and said second panel is a solid panel.

20. The tent of claim 15 further including a plurality of tent poles supporting solid canopy, said tent poles arching over said canopy and suspending said canopy from said poles, said first panel being a net panel and said second panel being a solid panel, and wherein said attachment comprises a zipper including a first panel zipper chain on said remaining edge portion of said net panel, a second panel zipper chain on said remaining edge portion of said solid panel, and a canopy opening zipper chain on said edge of said canopy surrounding said opening, and two zipper pulls for mating either said first panel zipper chain or said second panel zipper chain to said canopy opening zipper chain.

21. The tent of claim 15, further including a flysheet canopy mounted over and covering said solid canopy, said flysheet canopy having a window opening aligned with said convertible opening of said solid canopy.

22. The tent of claim 20 wherein said window opening of said flysheet contains a removable panel that can be removed and installed in said window opening of said flysheet canopy from inside said solid canopy.

23. The tent of claim 20 wherein said flysheet canopy is spaced from said solid canopy.

* * * * *